United States Patent [19]

Balordi

[11] 4,331,854

[45] May 25, 1982

[54] LOW FREQUENCY INDUCTION HEATER

[75] Inventor: Romano Balordi, Millers, Md.

[73] Assignee: Maryland Cup Corporation, Owings Mills, Md.

[21] Appl. No.: 125,455

[22] Filed: Feb. 28, 1980

[51] Int. Cl.[3] ..... H05B 5/08

[52] U.S. Cl. ..... 219/10.51; 219/10.49 R; 219/10.41; 219/10.65

[58] Field of Search ..... 219/10.41, 10.49 R, 219/10.51, 10.65, 10.69, 300, 301, 400, 469, 10.61 A, 10.79

[56] References Cited

U.S. PATENT DOCUMENTS

| | | | |
|---|---|---|---|
| 2,513,779 | 7/1950 | Bailey | 219/10.51 |
| 3,041,378 | 7/1962 | Holz | 219/10.51 |
| 3,071,675 | 1/1963 | Cronberger | 219/10.51 |
| 3,293,407 | 12/1951 | Ando | 219/301 |
| 3,428,771 | 2/1969 | Cleaver | 219/10.51 |
| 3,720,803 | 3/1973 | Lewis | 219/10.69 |
| 3,777,117 | 12/1973 | Othmer | 219/300 |
| 3,824,364 | 7/1974 | Cachat | 219/10.51 |
| 3,860,737 | 1/1975 | Moscatello | 13/27 |
| 4,147,591 | 3/1979 | Takeda | 219/10.49 R |

*Primary Examiner*—Volodymyr Y. Mayewsky
*Attorney, Agent, or Firm*—Birch, Stewart, Kolasch and Birch

[57] ABSTRACT

A low-frequency induction heater is disclosed for heating air or gas and dispelling this gas for sealing polycoated papers. The low frequency induction heater has an induction coil surrounding a steel core and a core insulator for heating the core and insulator through electromagnetic induction bypassing a low frequency AC current through the induction coil. Air or gas enters the low frequency induction heater through an air inlet and passes through the core and/or over the surface of the core insulator of the low frequency induction heater such that the heat generated in the core is transferred to the air or gas. The heated air or gas is then expelled from the low frequency induction heater through an outlet nozzle which is configured for sealing polycoated papers together in structures such as the lapped side seam of a cup sidewall.

9 Claims, 3 Drawing Figures

LOW FREQUENCY INDUCTION HEATER

FIELD OF INVENTION

This invention relates to low frequency induction heaters and more particularly to an induction heater for heating air or gas to a predetermined temperature for sealing polycoated papers and the like, such as in the formation of a side seam in a cup sidewall.

BACKGROUND OF THE INVENTION

It is an object of the present invention to provide a low frequency induction heater for heating air or gas to relatively high temperatures.

Another object of the present invention is to provide a low frequency induction heater for thermally bonding and sealing polycoated papers, such as in the formation of seams in standard two-piece paper cups.

These and other objects of the present invention will become more fully apparent with reference to the following specification and drawings which relate to preferred embodiments of the invention.

SUMMARY OF THE INVENTION

Figure 1:
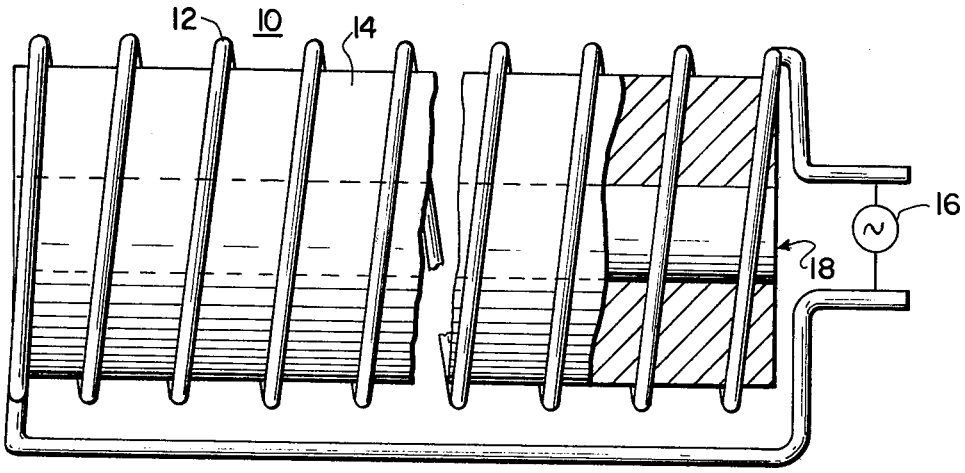
FIG. 1 is a schematic side elevation of a preferred embodiment of the low frequency induction heater of the present invention.

The low frequency induction heater of the present invention comprises an air inlet and an air outlet for allowing air or gas to enter the low frequency induction heater at one end and to exit from the induction heater at the other end. An induction coil helically surrounds a soft iron core disposed between the two ends of induction heater, the ends of the induction coil being disposed at one end of the core for attachment to a low frequency AC voltage source. The core has a cylindrical bore passing through the center thereof in communication with the air inlet and the air outlet.

The incoming air or gas enters the air inlet, enters the cylindrical bore, and passes through the cylindrical bore of the induction heater, approaching the air outlet.

The low frequency AC voltage source excites the induction coil and induces currents in the core. Heat is generated in the core which causes the air or gas, passing through the cylindrical bore of the induction heater, to increase in temperature. The heated air or gas is expelled to the atmosphere through the air outlet.

In another embodiment of the induction heater of the present invention, the induction heater includes an air inlet for allowing air or gas to enter the induction heater. A stainless steel core is surrounded by a core insulating material. Helical windings of an induction coil surround the core insulating material. One end of the helical windings of the induction coil physically and electrically attach to one end of the steel core. The other end of the helical windings of the induction coil and the other end of the steel core are physically and electrically attached, respectively, to two lead connections. These lead connections are further secured to both terminals of a low frequency AC voltage source. A ceramic shell surrounds the helical windings of the induction coil to insulate the induction coil from the steel outer housing of the low frequency induction heater.

An output diffuser is connected to the one end of the low frequency induction heater and has outlet ports disposed therethrough, directed in divergent directions, for the purpose of expelling the gas or air passing through the low frequency induction heater. The expelled gas or air is heated to a temperature on the order of 1,000° F. to 1200° F. and can be used for thermally sealing polycoated papers, for example, in the formation of the seams in standard cup sidewalls.

Incoming air passes through the air inlet, and travels between the helical windings of the induction coil, in close proximity with the core insulating material. The induction coil is energized by a low frequency AC voltage source. Current passes through the helical windings of the induction coil, and, as a result, by induction, the current passes through the steel core. Heat is generated in the steel core, which, in turn, heats the core insulating material. The heated core insulating material will, in turn, heat the air or gas as it passes in contact with the latter and the ceramic shell through the passages thus defined between the helical windings of the induction coil.

DETAILED DESCRIPTION OF THE DRAWINGS

Referring in detail to the drawings and with particular reference to FIG. 1, a preferred embodiment of a low frequency induction heater 10 of the present invention is shown as including an induction coil 12 which helically surrounds a steel core 14. The coil 12 is not in contact with the steel core 14. Both ends of the induction coil 12 are disposed at one end of the induction heater. The ends of the induction coil are connected to opposite sides of and excited by a low frequency alternating current source 16. A cylindrical bore 18 is disposed longitudinally through the center of the steel core 14 for permitting air or gas to pass therethrough in heat exchanging relationship therewith.

The induction coil is preferably made of a high-temperature steel material, specifically, stainless steel SAE approximately 6 millimeters in diameter. There are approximately twelve (12) turns of the induction coil 12 helically surrounding the steel core 14 of the low frequency induction heater 10 in the embodiment shown in FIG. 1.

The approximate dimensions of the low frequency induction heater of the present invention are shown in FIG. 1. This induction heater is approximately 120 millimeters in length, 50 millimeters in diameter, having a cylindrical bore 18 of 10 millimeters in diameter.

The low frequency alternating current source 16 in FIG. 1 provides an applied voltage of between 10 and 12 volts AC at 200 to 220 amperes, having a low frequency of approximately 60 HZ with a usable energy dissipation of 2.0 to 2.4 kilowatts AC.

Figure 2:
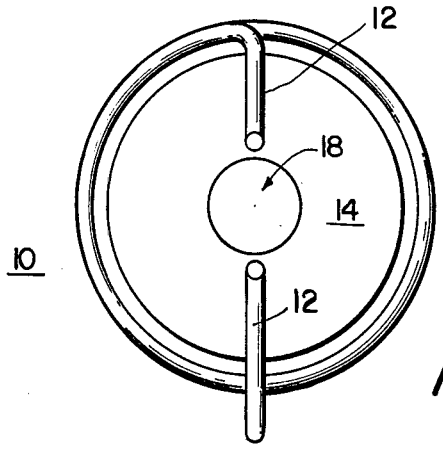
FIG. 2 is an end view of the low frequency induction heater of FIG. 1.

Referring to FIG. 2, representing an end view of the low frequency induction heater of FIG. 1, the direction of helical rotation of the induction coil 12 is illustrated as counterclockwise when viewed from the source-adjacent end thereof.

Figure 3:
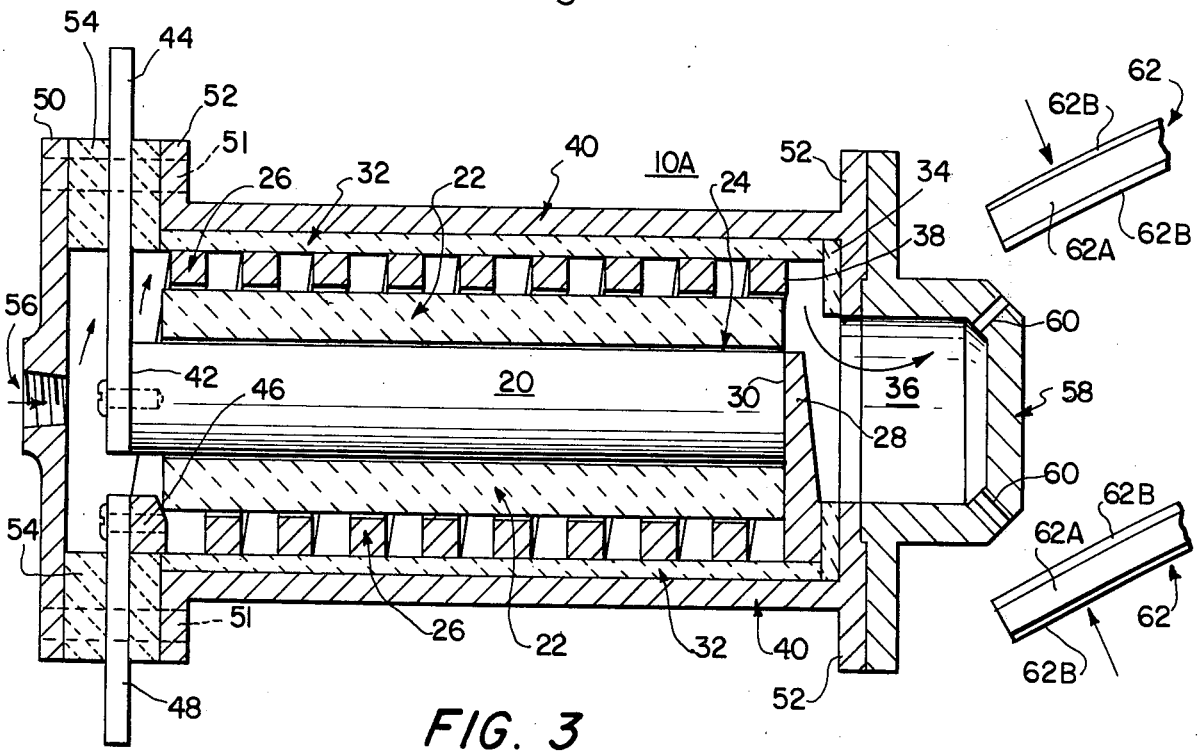
FIG. 3 is a cross-section of another preferred embodiment of the low frequency induction heater of the present invention illustrating its use in thermally sealing polycoated papers, and in particular, thermally sealing the seam of a cup sidewall during the forming of the latter from a blank.

Referring to FIG. 3, another preferred embodiment of a low frequency induction heater 10A of the present invention is illustrated as including a steel core 20 which consists of an elongated metal rod. An approximately cylindrically shaped ceramic core insulator 22 surrounds the core 20 to insulate the core 20 and to prevent the core from short circuiting with other metallic components of the induction heater. The core insulator 22 has a cylindrical bore 24 disposed longitudinally through the center thereof in which the steel core 20 is disposed.

An induction coil 26 helically surrounds the core insulator 22. One end 28 of the induction coil 26 is physically and electrically connected to one end 30 of the steel core 20.

A ceramic insulating shell 32 surrounds the induction coil 26, to prevent the induction coil 26 from short circuiting or engaging with the outer housing 40 of the induction heater.

An insulating disc 34 shaped like a washer is disposed about an outlet opening 36 in one end of the outer housing 40 and functions as a spacer for insulating the last turn 38 of the induction coil 26 from the outer metal housing 40 of the induction heater 10A.

The insulating disc 34 is also juxtaposed with one end of the ceramic insulating shell 32, to substantially enclose the core 20 and coil 26 within a shell of insulation.

The other end 42 of the steel core 20 is physically and electrically attached to a first lead connection 44.

The other end 46 of the induction coil 26 is physically and electrically attached to a second lead connection 48.

The steel outer housing 40 includes an end portion 50 and a body portion 52. Ceramic insulation material 54 is disposed between the end portion 50 and the body portion 52 of the steel outer housing 40 in juxtaposition with the end of the ceramic shell 32 opposite the insulating disc 34. The first lead connection 44, and the second lead connection 48, extend through the ceramic insulation material 54 and are connected to respective terminals of a low frequency alternating current source such as the source 16 of FIG. 1.

The end portion 50 and the body portion 52 of the steel outer housing 40 are attached and bolted to each other via bolts 51 or other suitable securing means. The ceramic insulation material 54 insulates the end portion 50 from the body portion 52 of the steel outer housing 40, and also insulates the first lead connection 44 and the second lead connection 48 from the end portion 50 and the body portion 52 of the steel outer housing 40.

An input port 56 is disposed through the center of the end portion 50 of the steel outer housing 40. This input port 56 is adapted to be connected to a suitable source of air or gas (not shown) and allows incoming air or gas from that source to enter the low frequency induction heater.

An output diffuser 58 is attached to the opposite end of the low frequency induction heater from the end portion 50 and in particular, is attached to the body portion 52 of the steel outer housing 40. This output diffuser 58 includes outlet ports 60 which are directed in divergent directions to allow the air or gas being expelled therefrom to be directed against opposed surfaces of adjacent edges of polycoated papers, 62 or the like prior to pressing these together to form the lapped side seam of a cup sidewall or the like. The coated papers 62 are illustrated as paper laminates 62A and thermoplastic polymer laminates 62B, the latter being, for example, polyethylene, PVC, etc.

In operation, referring to FIG. 1, the low frequency AC voltage source 16 electrically excites the induction coil 12 with low frequency AC power, thereby generating heat in the core 14 by electromagnetic induction. Air or gas enters the cyindrical bore 18 of the core 14 with the gas increasing in temperature as it passes through the said cylindrical bore, due to the heat present in the core 14. When the air or gas is expelled from the low frequency induction heater of FIG. 1, the air or gas has been heated.

Referring to FIG. 3, air or gas enters the input port 56 of the low frequency induction heater 10A which has been excited by a suitable AC source in the same manner as the heater 10 of FIG. 1. The air or gas is then conveyed through the passages defined between the convolutes of the helical windings of the induction coil 26, the core insulator 22 and the ceramic sleeve 32. The low frequency AC source (not shown) excites the coil 26 via the first and second lead connections 44 and 48, respectively. A current is induced in the core 20. The current pasing through the core 20 in conjunction with the heat of induction causes the core to heat. This, in turn, causes the core insulator 22 to be heated by thermal conduction of heat from the core 20. As the air or gas passes through the spacings of the helical windings of the induction coil 26, the air or gas increases in temperature due to a transfer of heat from the core insulator 22 to the gas passing therethrough.

As the air or gas is expelled from the low frequency induction heater in FIG. 3, through the output ports 60 of the output diffuser 58, the heated gas is directed in divergent directions against surfaces to be heated or sealed such as the opposed surfaces of the thermoplastic laminates 62B. Alternatively, the laminate 62B on one of the paper edges 62 may be juxtaposed with a paper laminate 62A to effect a lapped seal after heating by the heated gas or air emitted from the diffuser 58.

The invention being thus described, it will be obvious that the same may be varied in many ways. Such variations are not to be regarded as a departure from the spirit and scope of the invention, and all such modifications as will be obvious to one skilled in the art are intended to be included within the scope of the following claims.

It is claimed:

1. An induction heater means for heating a gas as said gas passes therethrough and energizable by a low frequency alternating current from a power source means, said heater means comprising:

sheathed induction coil means having convolute winding means extending axially thereof and responsive to the said alternating current from a said power source means for generating a variable electromagnetic field in response thereto;

core means disposed substantially coextensively with and through said induction coil means and insulated therefrom for generating heat therein in response to said variable electromagnetic field;

said core means and said sheathed induction coil means defining a heat exchange flow path therebetween following said convolute winding means from one end to the other thereof;

connecting means for placing said winding means electrically in series with said core means across a said power source means providing a low frequency alternating current;

gas inlet means on said sheathed winding means for ingesting gas to be heated into one end of said heat exchange flow path; and gas outlet means on said sheathed winding means for directing a flow of heated gas away from the other end of said heat exchange flow path;

said gas being heated in said flow path by mutual heat exchanging contact with said sheathed winding means and said core means.

2. An induction heater means in accordance with claim 1 further comprising:

core insulator means disposed between said core means and said induction coil means for separating and electrically insulating said induction coil means from said core means.

3. An induction heater means in accordance with claim 1, wherein said gas outlet means comprises:

output diffuser means disposed at one end of said induction heater means contiguous with said other ends of said core means and said induction coil means for expelling said gas from said induction heater means in a predetermined manner after said gas has been heated therein.

4. An induction heater in accordance with claim 1, wherein said sheathed induction coil means comprises:

outer metallic shell means for peripherally retaining said gas inlet means and gas outlet means on opposite ends of said induction heater means; and ceramic insulating shell means disposed between and electrically insulating from one another said convolute winding means and said outer metallic shell means.

5. An induction heater means in accordance with claim 4, further comprising:

ceramic insulation means disposed between and electrically insulating from one another said gas inlet means and said outer metallic shell means; and said connecting means further comprising first and second lead means extending through said ceramic insulation means to adjacent ends of said core means and said convolute winding means.

6. An induction heater means for heating and directing a flow of gas against a workpiece, comprising:

power source means for providing a low frequency alternating current;

induction coil means having a convolute winding means extending axially thereof, said winding being energizable by said low frequency alternating current from said power source means for generating a variable electromagnetic field therein;

core means disposed substantially coextensively with and through said induction coil means and electrically insulated therefrom for generating heat therein in response to a said variable electromagnetic field, said core means and said sheathed induction coil means defining a heat exchange flow path therebetween following said convolute winding means from one end to the other end of said induction heater means;

connecting means for placing said convolute winding means electrically in series with said core means across said power source means;

gas inlet means on said one end of said induction heater means for ingesting gas to be heated into one end of said heat exchange flow path; and gas outlet means on said other end of said induction heater means for directing a flow of heated gas away from the other end of said heat exchange flow path;

said gas being heated in said flow path by mutual heat exchange contact with said sheathed induction coil means and said core means; and said gas outlet means comprising output diffuser means disposed at said other end of said induction heater means contiguous with adjacent ends of said core means and said sheathed induction coil means for expelling the heated gas therefrom and directing said heated gas against said workpiece.

7. An induction heater means in accordance with claim 6, wherein said sheathed induction coil means comprises:

an outer metallic shell means for peripherally retaining said diffuser means; and ceramic insulating shell means disposed between and electrically insulating from one another said convolute winding means and said outer metallic shell means.

8. An induction heater means in accordance with claim 7, further comprising:

ceramic insulation means disposed between and electrically insulating from one another said gas inlet means and said outer metallic shell means; and said connecting means further comprising first and second lead means extending through said ceramic insulation means, said lead means being connected on first ends thereof to respective sides of said power source means and on the other ends thereof to adjacent ends of said core means, and end of said induction coil means, respectively.

9. A method of heating a gas using an induction heater including a sheathed induction coil surrounding a steel core, said induction coil having convolute winding means extending axially thereof, said core and said sheathed induction coil defining a heat exchange flow path therebetween following said convolute winding means from one end to the other thereof, comprising the steps of:

energizing said induction coil with low frequency alternating current power thereby heating said core; and conveying said gas through said flow path, to heat said gas by mutual heat exchanging contact with said sheathed induction coil and said core.

* * * * *